US009556671B1

(12) United States Patent
Grimes

(10) Patent No.: US 9,556,671 B1
(45) Date of Patent: Jan. 31, 2017

(54) PRIVACY SCREENING AND TRACK SYSTEM

(71) Applicant: Gregory Grimes, Temple, TX (US)

(72) Inventor: Gregory Grimes, Temple, TX (US)

( * ) Notice: Subject to any disclaimer, the term of this patent is extended or adjusted under 35 U.S.C. 154(b) by 1 day.

(21) Appl. No.: 14/600,203

(22) Filed: Jan. 20, 2015

(51) Int. Cl.
*E06B 9/52* (2006.01)
*E06B 9/24* (2006.01)

(52) U.S. Cl.
CPC .. *E06B 9/52* (2013.01); *E06B 9/24* (2013.01); *E06B 2009/2423* (2013.01); *E06B 2009/527* (2013.01)

(58) Field of Classification Search
CPC ..... E06B 9/24; E06B 9/52; E06B 2009/527; E06B 2009/2423; E06B 3/96; E04B 1/0046; E04B 1/343
USPC ..... 160/135, 371
See application file for complete search history.

(56) References Cited

U.S. PATENT DOCUMENTS 3,052,291 A * 9/1962 Fellers ..... E04B 1/0046 160/88
3,256,659 A * 6/1966 Dudoff ..... E04B 2/7433 52/239
4,516,620 A 5/1985 Mulhern
5,347,778 A * 9/1994 Bray ..... E04B 2/7425 160/135
5,586,593 A * 12/1996 Schwartz ..... A47G 5/00 160/135
6,003,279 A * 12/1999 Schneider ..... E04B 1/0046 403/230
6,032,684 A 3/2000 Narron
6,415,567 B1 * 7/2002 Mead ..... E04B 2/7422 160/135
6,942,002 B1 9/2005 Williams
2008/0163563 A1 * 7/2008 Sciglia ..... E04H 3/165 52/63
2010/0132285 A1 * 6/2010 Wood ..... E04B 1/0046 52/274

FOREIGN PATENT DOCUMENTS

GB 824583 * 12/1959

* cited by examiner

*Primary Examiner* — Blair M Johnson
(74) *Attorney, Agent, or Firm* — Stevenson IP, LLC

(57) ABSTRACT

The privacy screening and track system is a modularly constructible screen system that provides screen panels on tracks such that screen panels may be optionally opened or closed as might windows be. The system provides corner posts, center posts, and end posts joinable to top and bottom tracks wherein the modularity is continued as desired. The system also provides components that can be cut as needed, even by a novice, such that both manufactured fit and user custom fit are possible. Screens provide translucent views and alternately transparent views.

4 Claims, 7 Drawing Sheets

PRIVACY SCREENING AND TRACK SYSTEM

BACKGROUND OF THE INVENTION

Various types of privacy screens are known in the prior art. Most screens are ii built in, with screen dimensions having to be met during building construction, or existing screen offerings must be custom built to accommodate various structures to which the screens are fitted. Additionally existing screens are not typically equipped with corners. What has been needed is a modularly constructible screen system that provides screen panels on tracks such that screen panels may be optionally opened or closed as might windows be. Further, a screen system is needed that provides corner post, center posts and end posts wherein the modularity is continued as desired. Such a system must be easily assembled even by a novice, and even offer the capability of being cut to fit by the novice. The present system provides these advantages.

FIELD OF THE INVENTION

The present privacy screening and track system relates to screens fitted to porches, windows and various structures, and more especially to a modular screening and track system that is size adjustable and readily assembled to fit various dimensional openings and also provides corner posts to form the system around corners.

SUMMARY OF THE INVENTION

The general purpose of the privacy screening and track system, described subsequently in greater detail, is to provide a privacy screening and track system that has many novel features that result in a privacy screening and track system which is not anticipated, rendered obvious, suggested, or even implied by prior art, either alone or in combination thereof.

To accomplish this, the privacy screening and track system comprises a modular structure having a plurality of end posts, a plurality of corner posts, and a plurality of center posts. A plurality of apertures is provided. Each end post, corner post, and center post has one aperture on a top end. A plurality of projections is provided. Each end post, corner post, and center post has one projection on a bottom end. The post apertures are continuous to the projections, therein enabling cutting of the posts to a desired size while providing for identical fit of the originally supplied posts. A plurality of channel pairs is provided. Each channel pair has one channel adjacent and parallel to the other channel of the pair. One channel pair is disposed in each end post. One channel pair is disposed in one of a pair of opposite sides of each center post. One channel pair is disposed in one of a pair of adjacent sides of each corner post. Each post is spaced apart from at least one post. The posts are arranged as needed to accommodate a given building or space.

A plurality of top tracks and bottom tracks is provided. One top track is optionally fitted adjacent the top ends of the most proximal posts. Each top and bottom track has a channel pair continuously disposed therein. Top tracks and bottom tracks remain functional as original when trimmed to length. Each bottom track is optionally fitted adjacent the bottom ends of proximally positioned posts. A plurality of end caps is provided. Each end cap has one projection. One end cap optionally secures one end post to one top track.

A plurality of center caps is provided. Each center cap has one projection. One center cap optionally secures one center post to two top tracks. A plurality of corner caps is provided. Each corner cap has one projection. Each corner cap optionally secures one corner post to two top tracks. An at least one trough is disposed in each cap wherein each trough partially overlaps a top track and therein secures top tracks to posts.

A plurality of mount standards is provided. Each mount standard has one aperture. One of each post projection is optionally disposed within one mount standard aperture wherein at least one bottom track is secured to at least one post. A plurality of screen panels is provided. Each screen panel has a top piece spaced apart from a bottom piece and a first piece spaced apart from a second piece. Each piece has a continuous groove. Each piece can be fitted as supplied originally or trimmed to accommodate various sized openings to which the posts and tracks are cut to provide. A screen is affixed within the grooves whether originally or by a user. One method of assembly is to slidably fit first and second pieces to one screen, then fit the top and bottom pieces to the same screen to bring the screen taught. Each piece has a right angled slot in an each opposite end. Each panel has a plurality of couplers. Each coupler has a one tab disposed on each of a pair of adjacent tab sides wherein one top piece and one bottom piece is secured to each first piece and each second piece. Each screen panel is slidably fitted within at least one of the channels of at least three channel pairs.

The modular system is also available in basic forms wherein only end posts and screen panels are provided. The system is also available with only end posts and center posts. The system is further provided with only end posts and corner posts. Differing dimensions of screen panels and of posts and top tracks and bottom tracks are provided. As noted and also important is that posts, tracks, pieces, and screens can be cut to fit various dimensional needs and still assemble and disassemble as if of original sizes. The screens are available in a mesh such that at a distance or an angle the screens are translucent.

Thus has been broadly outlined the more important features of the present privacy screening and track system so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
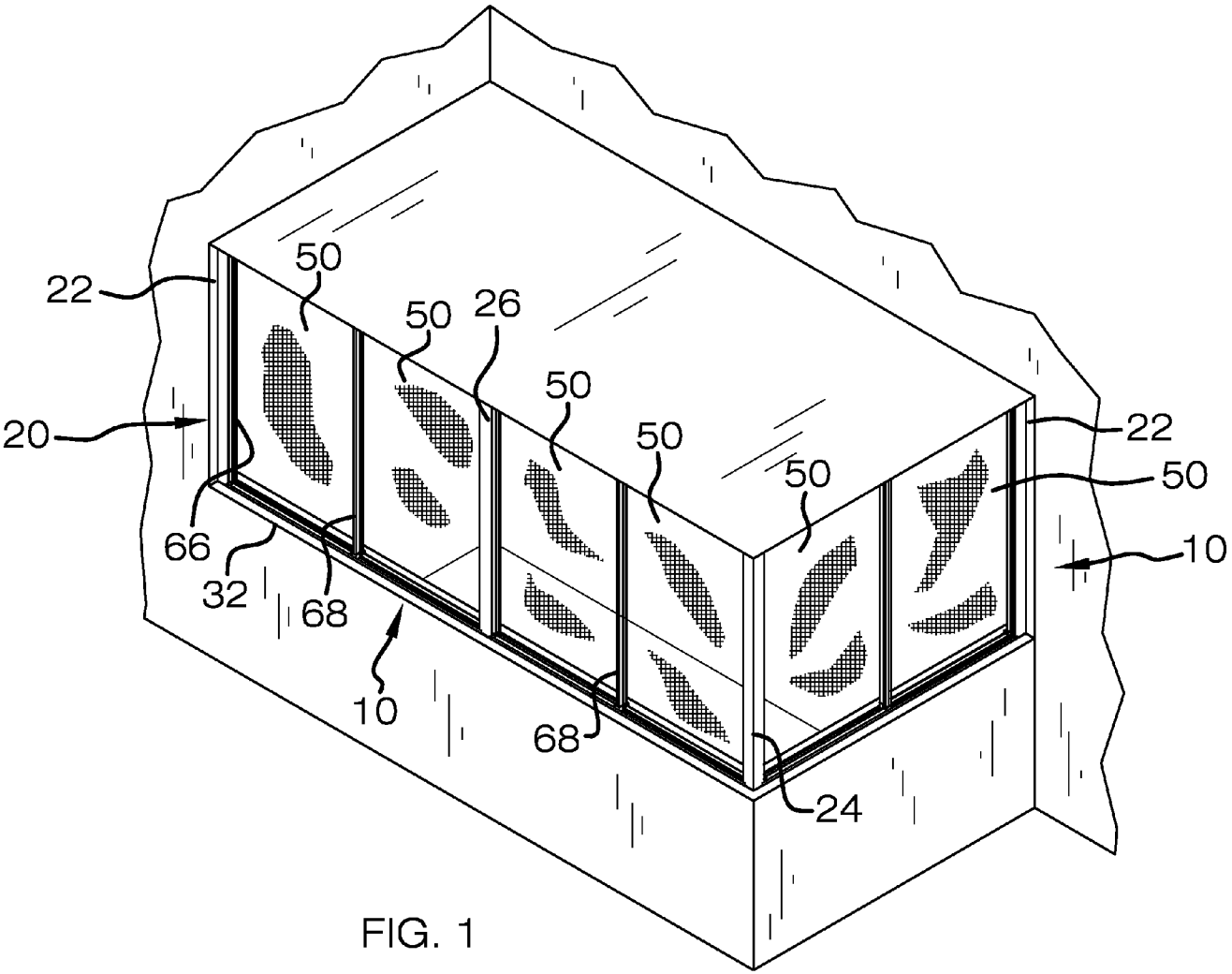
FIG. 1 is an in use perspective view.
Figure 2:
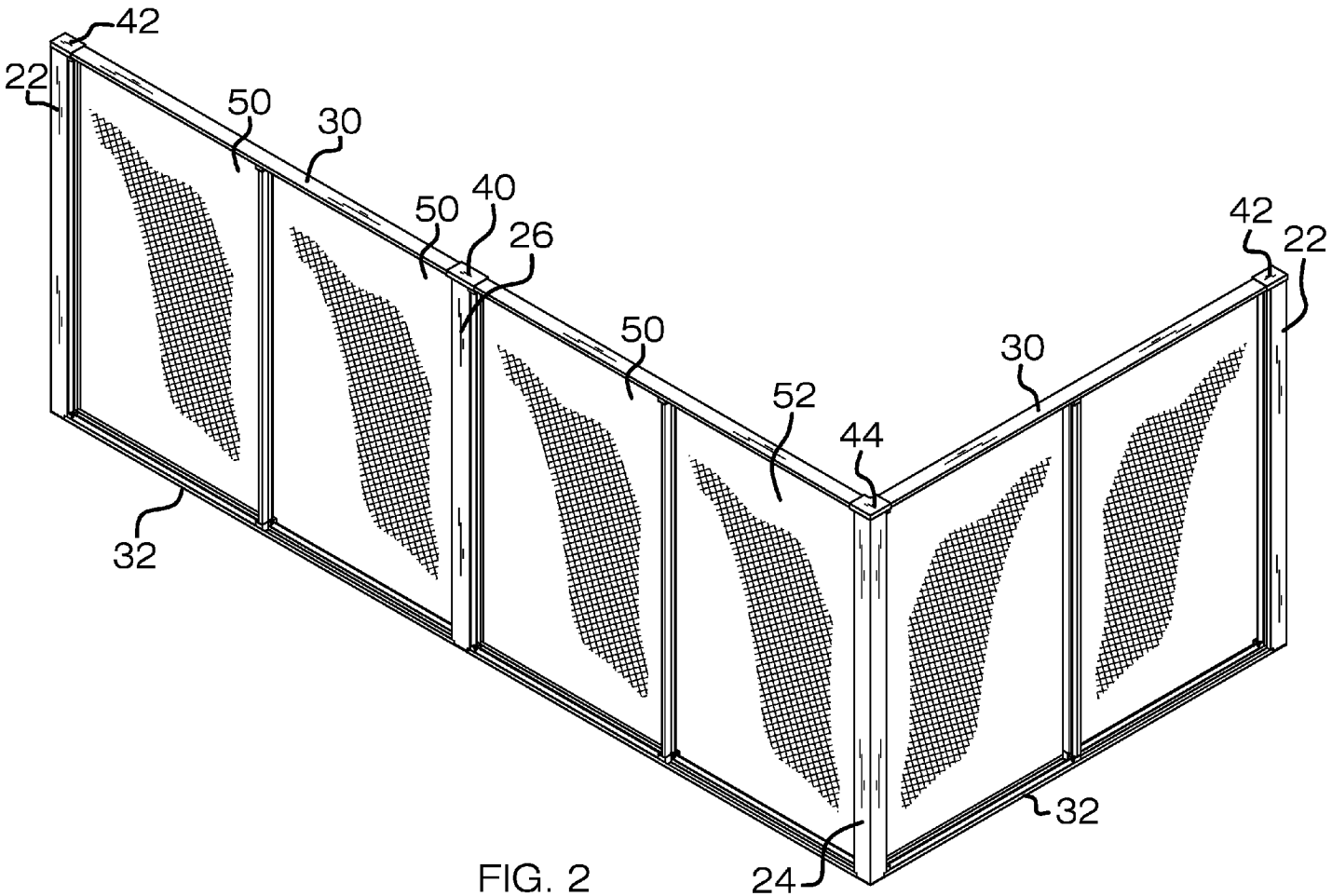
FIG. 2 is a perspective view.
Figure 3:
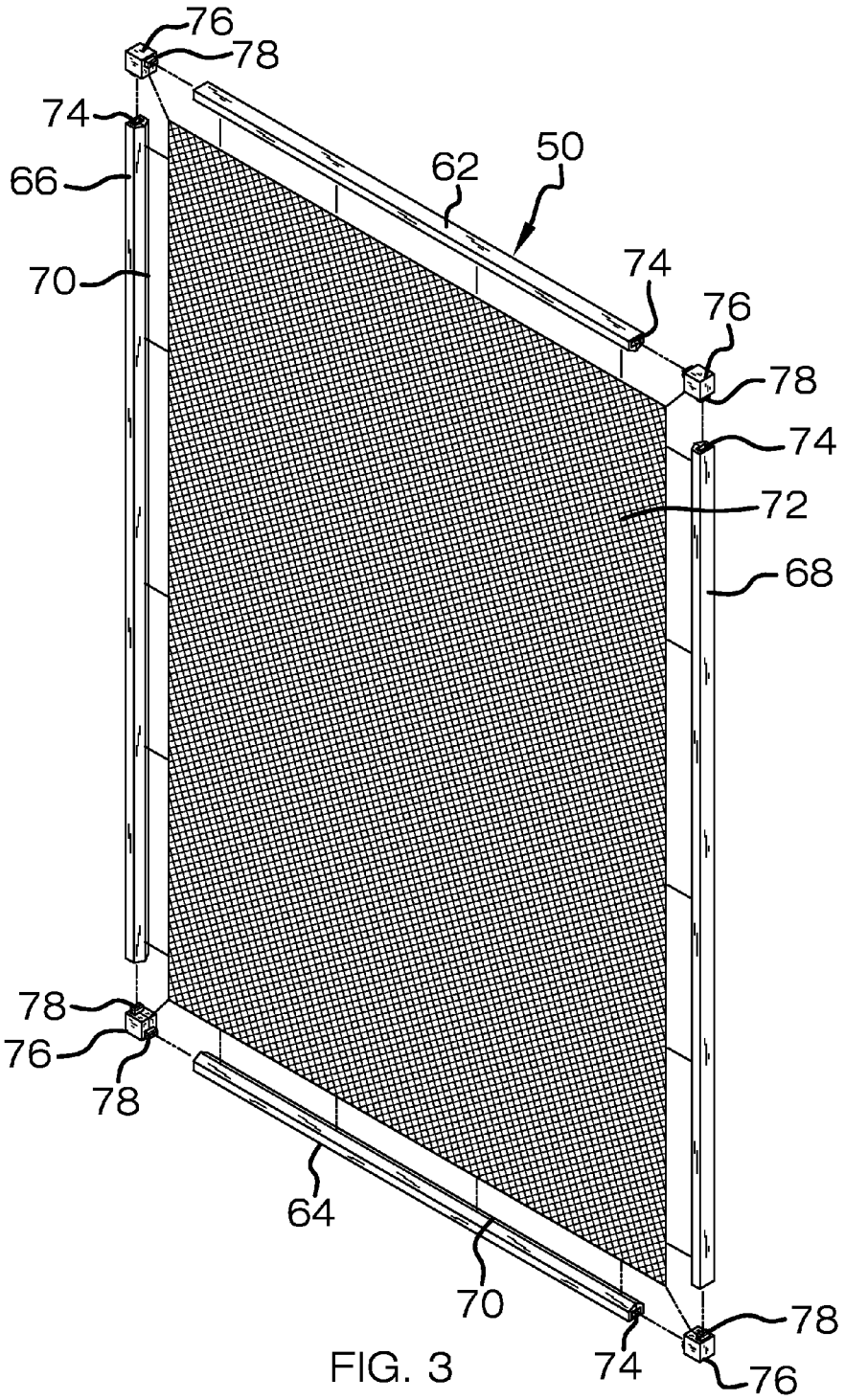
FIG. 3 is an exploded perspective view of a screen panel.
Figure 4:
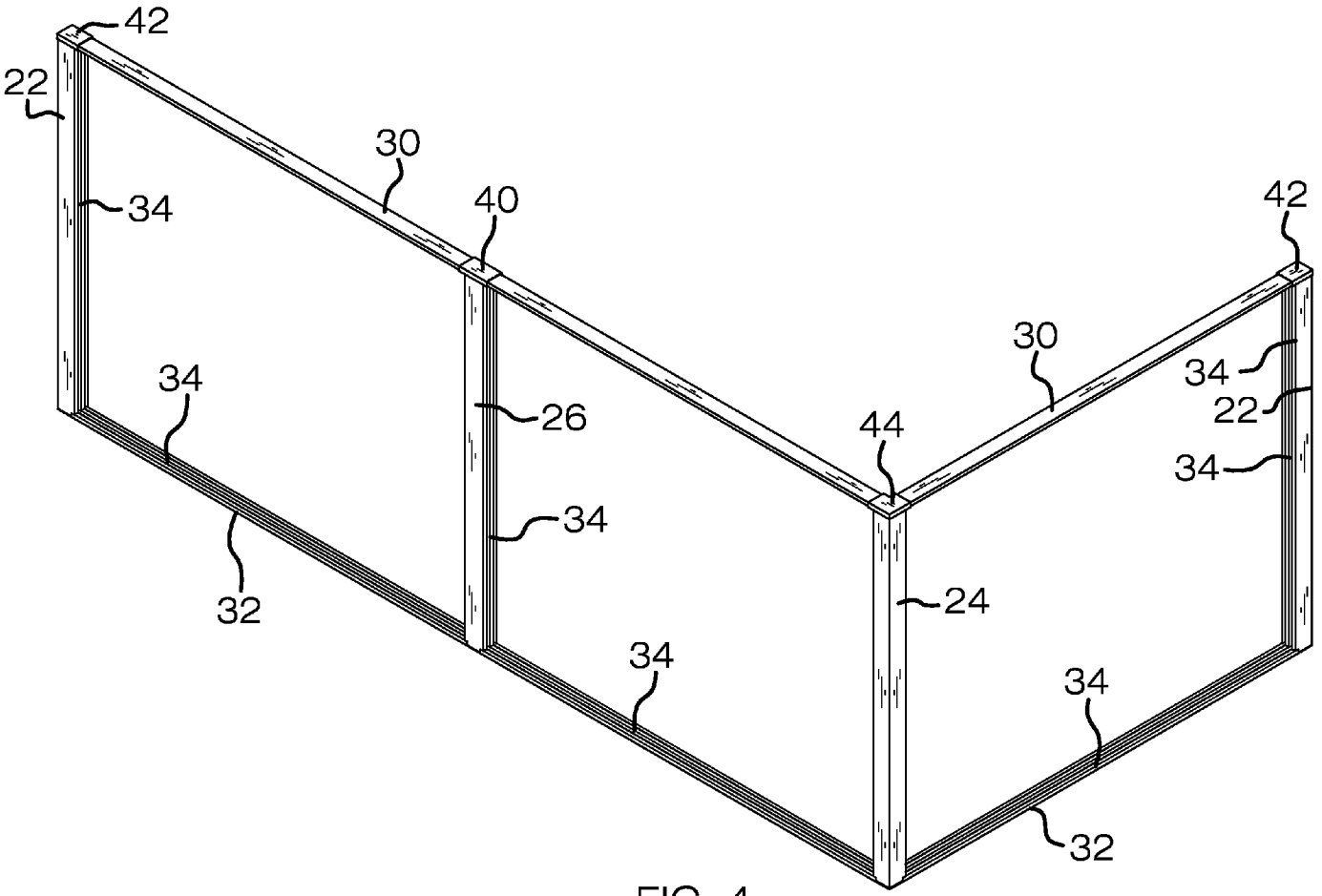
FIG. 4 is a perspective view without screen panels.
Figure 5:
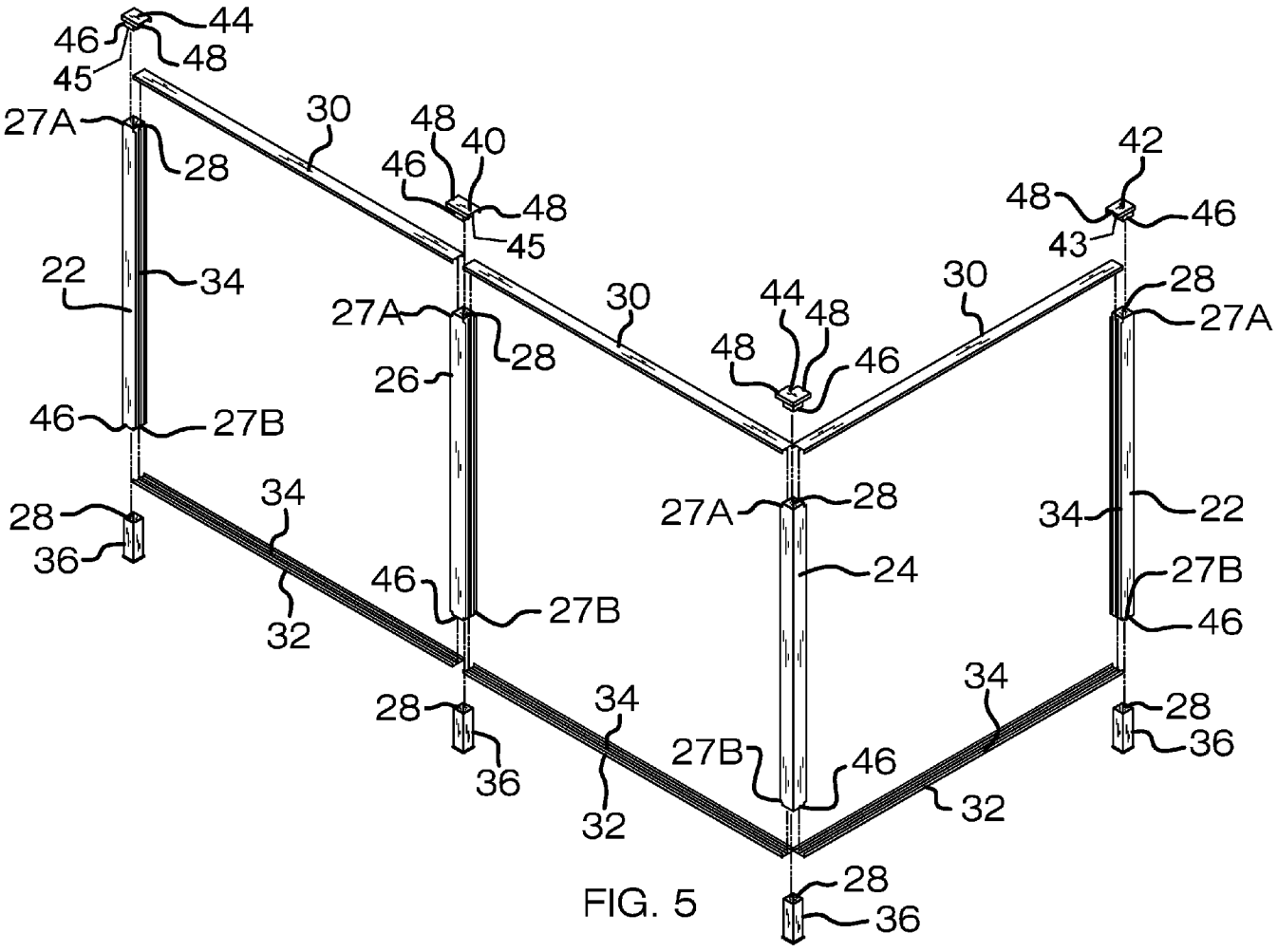
FIG. 5 is an exploded perspective view without screen panels.
Figure 6:
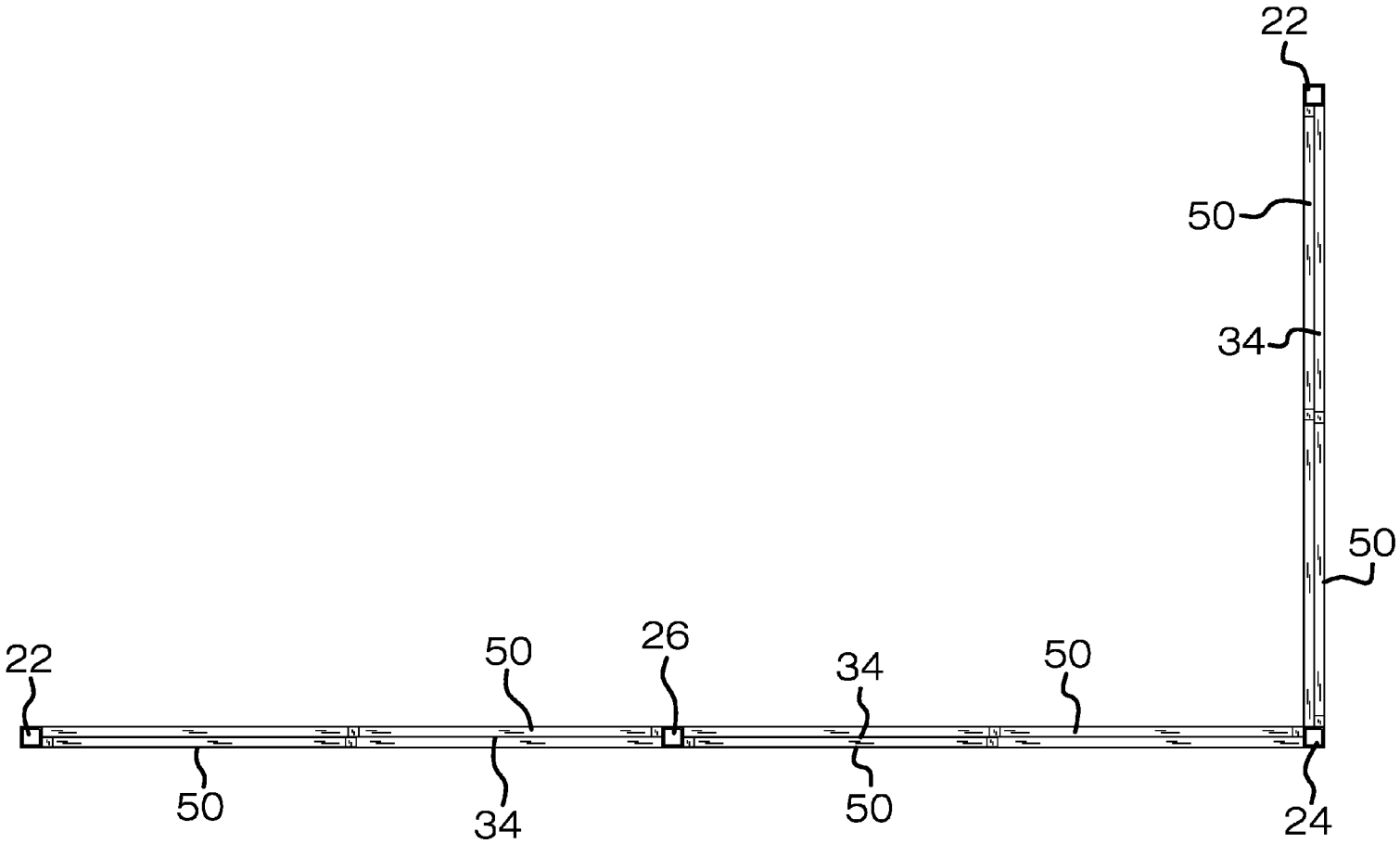
FIG. 6 is a top plan view without a plurality of caps and top tracks.
Figure 7:
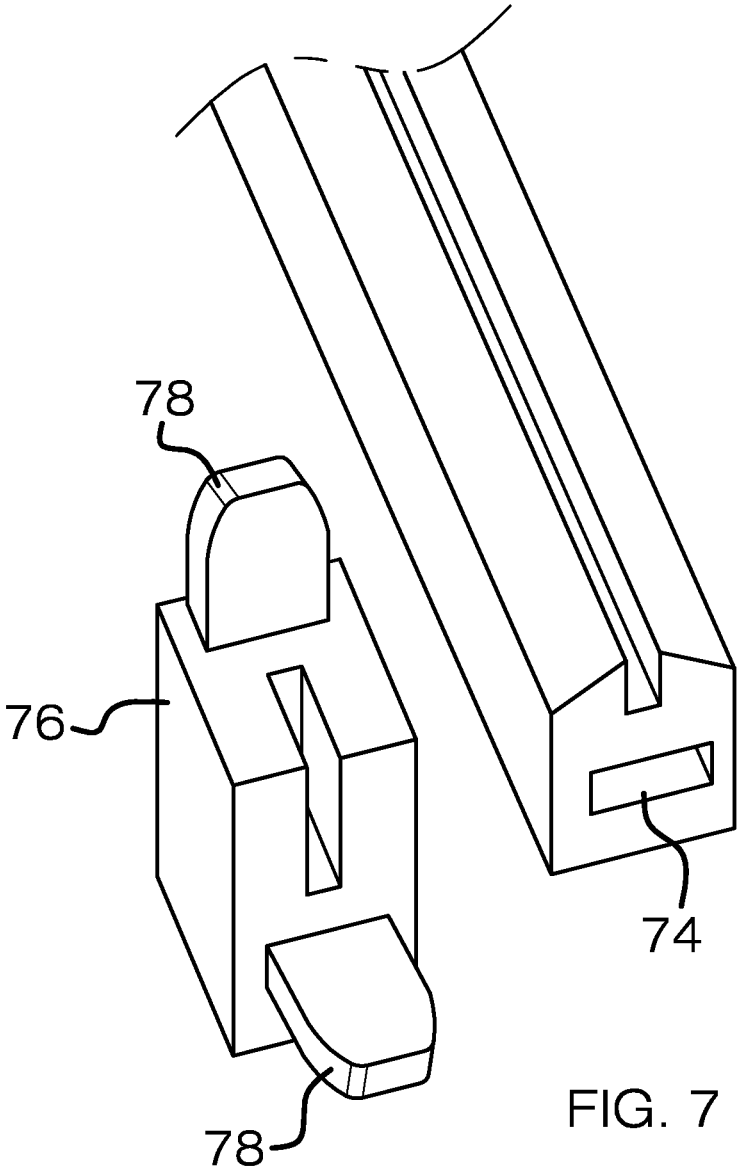
FIG. 7 is a perspective view of a right angle notch in preparation of receiving a tab of a coupler.

With reference now to the drawings, and in particular FIGS. 1 through 7 thereof, an example of the privacy screening and track system employing the principles and concepts of the present privacy screening and track system and generally designated by the reference number 10 will be described.

Referring to FIGS. 1 through 7, the privacy screening and track system 10 provides a modular structure 20 having a plurality of end posts 22, a plurality of corner posts 24, and a plurality of center posts 26. A plurality of apertures 28 is provided. Each end post 22, corner post 24, and center post 26 has one aperture 28 continuously disposed from a top end 27A to a bottom end 27B.

A plurality of projections 46 is provided. Each end post 22, corner post 24, and center post 26 has one projection 46 on the bottom end 27B. A plurality of channel pairs 34 is also provided. Each channel pair 34 has one channel adjacent and parallel to the other channel of the pair of channels. One channel pair 34 is continuously disposed in each end post 22. One channel pair 34 is continuously disposed in one of a pair of opposite sides of each center post 26. One channel pair 34 is continuously disposed in one of a pair of adjacent sides of each corner post 24. Each post 22, 24, 26 is spaced apart from at least another one of the posts 22, 24, 26.

A plurality of top tracks 30 and bottom tracks 32 is provided to connect the posts 22, 24, 26 together. Each of the top tracks 30 and the bottom tracks 32 has one channel pair 34 continuously disposed therein. Each top track 30 and bottom track 32 is optionally fitted adjacent the top ends 27A and the bottom ends 27B, respectively, of the most proximal posts 22, 24, 26. A plurality of end caps 42 is provided to connect the top tracks 30 to the posts 22, 24, 26. Each end cap 42 has a respective one of the plurality of projections 46 on a bottom side 43 of each one of the plurality of end caps 42. One end cap 42 optionally secures one end post 22 to one top track 30.

A plurality of center caps 40 and corner caps 44 is provided. Each center cap 40 and each corner cap 44 has a lower side 45 and one of the plurality of projections 46 disposed on the lower side 45 of the respective one of the center cap 40 and the corner cap 44. One center cap 40 optionally secures one center post 26 to two top tracks 30. Each corner cap 44 optionally secures one corner post 24 to two top tracks 30. At least one trough 48 is disposed in each of the center caps 40, end caps 42, and corner caps 44. Each trough 48 partially overlaps a top track 30. A plurality of mount standards 36 is provided. Each mount standard 36 has one aperture 28. One of each post 22, 24, 26 projection 46 is optionally disposed within one mount standard 36 aperture 28 to secure at least one bottom track 32 to at least one post 22, 24, 26.

A plurality of screen panels 50 is provided. Each screen panel 50 has a top piece 62 spaced apart from a bottom piece 64 and a first piece 66 spaced apart from a second piece 68. Each of the top, bottom, first, and second pieces 62, 64, 66, 68 has a groove 70 continuously disposed therein. A screen 72 is affixed within the grooves 70. Each of the top, bottom, first, and second pieces 62, 64, 66, 68 has a right angled slot 74 continuously disposed therein extending from one terminus to another terminus. Each screen panel 50 has a plurality of couplers 76. Each coupler 76 has a one tab 78 disposed on each of a pair of adjacent tab 78 sides wherein one top piece 62 and one bottom piece 64 is secured to each first piece 66 and each second piece 68. At least the bottom piece 64, the first piece 66, and the second piece 68 of each screen panel 50 slidably engages the pair of channels 34 of a respective one of the bottom track 32, the end post 22, the corner post 24, and the center post 26.

What is claimed is:

1. A privacy screening and track system comprising:

a modular structure having a plurality of posts comprising a plurality of end posts and a plurality of center posts, the modular structure further having a plurality of apertures, each of the posts having one aperture disposed on a top end thereof, a plurality of projections, each of the posts having one of the plurality of projections disposed on a bottom end thereof, a plurality of adjacent parallel channel pairs, one channel pair disposed in each end post, one channel pair disposed in one of a pair of opposite sides of each center post;

wherein each post is spaced apart from at least another one of the posts;

a plurality of top tracks, each top track having a channel pair, each top track optionally fitted adjacent the top ends of the most proximal posts;

a plurality of bottom tracks, each bottom track having a channel pair, each bottom track optionally fitted adjacent the bottom ends of proximal posts;

a plurality of end caps, each end cap having a bottom side and one of the plurality of projections on the bottom side, one end cap optionally securing one end post to one top track;

a plurality of center caps, each center cap having one of the plurality of projections on a lower side thereof, one center cap optionally securing one center post to two top tracks;

at least one trough disposed in each cap, wherein each trough partially overlaps a top track; and a plurality of mount standards, each one of the plurality of mount standards having one aperture, each one of the plurality of projections disposed on the bottom end of the respective one of the posts being insertable within the aperture of a respective one of the mount standards, wherein at least one bottom track is secured to at least one post upon the insertion of the respective one of the plurality of projections within the aperture of the respective one of the mount standards; and a plurality of screen panels, wherein each screen panel has a top piece, a bottom piece, a first piece and a second piece, wherein at least the bottom piece, the first piece, and the second piece of each screen panel slidably engages the pair of channels of a respective one of the bottom track, the end post, the corner post, and the center post.

2. The system of claim 1 wherein each channel pair is continuously disposed within each track.

3. A privacy screening and track system comprising:

a modular structure having a plurality of end posts, a plurality of corner posts, a plurality of center posts, a plurality of apertures, each end, corner, and center post having one aperture on a top end, a plurality of projections, each end, corner, and center post having one of the plurality of projections on a bottom end, a plurality of adjacent parallel channel pairs, one channel pair disposed in each end post, one channel pair disposed in one of a pair of opposite sides of each center post, one channel pair disposed in one of a pair of adjacent sides of each corner post;

wherein each post is spaced apart from at least another one of the posts;

a plurality of top tracks, each top track having a channel pair, each top track optionally fitted adjacent the top ends of the most proximal posts;

a plurality of bottom tracks, each bottom track having a channel pair, each bottom track optionally fitted adjacent the bottom ends of proximal posts;

a plurality of end caps, each end cap having a bottom side and one of the plurality of projections on the bottom side, one end cap optionally securing one end post to one top track;

a plurality of center caps, each center cap having one projection of the plurality of projections on a lower side thereof, one center cap optionally securing one center post to two top tracks;

a plurality of corner caps, each corner cap having one projection of the plurality of projections on a lower side thereof, each corner cap optionally securing one corner post to two top tracks;

an at least one trough disposed in each cap wherein each trough partially overlaps a top track;

a plurality of mount standards, each one of the plurality of mount standards having one aperture, each one of the plurality of projections disposed on the bottom end of the respective one of the posts being insertable within the aperture of a respective one of the mount standards, wherein at least one bottom track is secured to at least one post upon the insertion of the respective one of the plurality of projections within the aperture of the respective one of the mount standards; and a plurality of screen panels, each screen panel having a top piece spaced apart from a bottom piece, a first piece spaced apart from a second piece, each piece having a groove, a screen affixed within the grooves; each piece having a right angled slot in an each opposite end, each panel having a plurality of couplers, each coupler having a one tab disposed on each of a pair of adjacent tab sides wherein one top piece and one bottom piece is secured to each first piece and each second piece;

wherein at least the bottom piece, the first piece, and the second piece of each screen panel slidably engages the pair of channels of a respective one of the bottom track, the end post, the corner post, and the center post.

4. A privacy screening and track system comprising:

a modular structure having a plurality of end posts, a plurality of corner posts, a plurality of center posts, plurality of projections, each end, corner, and center post having one projection of the plurality of projections on a bottom end, a plurality of apertures, each end, corner, and center post having one aperture continuously disposed from a top end to the projection of the plurality of projections on the bottom end, a plurality of adjacent continuously disposed parallel channel pairs, one channel pair disposed in each end post, one channel pair disposed in one of a pair of opposite sides of each center post, one channel pair disposed in one of a pair of adjacent sides of each corner post;

wherein each post is spaced apart from at least one post;

a plurality of top tracks, each top track having a channel pair continuously disposed therein, each top track optionally fitted adjacent the top ends of the most proximal posts;

a plurality of bottom tracks, each bottom track having a continuously disposed channel pair, each bottom track optionally fitted adjacent the bottom ends of proximal posts;

a plurality of end caps, each end cap having a bottom side and one of the plurality of projections on the bottom side, one end cap optionally securing one end post to one top track;

a plurality of center caps, each center cap having one projection of the plurality of projections on a lower side thereof, one center cap optionally securing one center post to two top tracks;

a plurality of corner caps, each corner cap having one projection of the plurality of projections on a lower side thereof, each corner cap optionally securing one corner post to two top tracks;

at least one trough continuously disposed in each cap wherein each trough partially overlaps a top track;

a plurality of mount standards, each one of the plurality of mount standards having one aperture, each one of the plurality of projections disposed on the bottom end of the respective one of the posts being insertable within the aperture of a respective one of the mount standards, wherein at least one bottom track is secured to at least one post upon the insertion of the respective one of the plurality of projections within the aperture of the respective one of the mount standards; and a plurality of screen panels, each screen panel having a top piece spaced apart from a bottom piece, a first piece spaced apart from a second piece, each piece having a groove continuously disposed from an end to an opposite end, a screen affixed within the grooves; each piece having a right angled slot continuously disposed from the end to the opposite end, each panel having a plurality of couplers, each coupler having a one tab disposed on each of a pair of adjacent tab sides wherein one top piece and one bottom piece is secured to each first piece and each second piece;

wherein at least the bottom piece, the first piece, and the second piece of each screen panel slidably engages the pair of channels of a respective one of the bottom track, the end post, the corner post, and the center post.

* * * * *